US007509786B2

(12) United States Patent
Thatenhorst

(10) Patent No.: US 7,509,786 B2
(45) Date of Patent: Mar. 31, 2009

(54) BEVERAGE BOTTLING PLANT FOR FILLING BOTTLES WITH A LIQUID FILLING MATERIAL WITH AN ADJUSTABLE LABELING MECHANISM FOR LABELING BOTTLES, AND A METHOD OF OPERATING A BEVERAGE BOTTLING PLANT

(75) Inventor: Klaus Thatenhorst, Holzwickede (DE)

(73) Assignee: KHS Maschinen- und Anlagenbau AG, Dortmund (DE)

( * ) Notice: Subject to any disclaimer, the term of this patent is extended or adjusted under 35 U.S.C. 154(b) by 333 days.

(21) Appl. No.: 11/051,999

(22) Filed: Feb. 4, 2005

(65) Prior Publication Data

US 2005/0188655 A1 Sep. 1, 2005

(30) Foreign Application Priority Data

Feb. 6, 2004 (DE) ..... 10 2004 005 994

(51) Int. Cl.
*B65B 5/00* (2006.01)
*B65B 7/28* (2006.01)

(52) U.S. Cl. ..... 53/253

(58) Field of Classification Search ..... 53/253, 53/331.5, 317, 319, 428, 431
See application file for complete search history.

(56) References Cited

U.S. PATENT DOCUMENTS 3,139,368 A 6/1964 Flood
3,924,381 A * 12/1975 Sardo ..... 53/431
4,242,168 A 12/1980 Carter
5,078,826 A * 1/1992 Rogall ..... 156/451
5,227,005 A * 7/1993 Zodrow et al. ..... 156/566
5,642,601 A * 7/1997 Thompson et al. ..... 53/431
5,713,403 A * 2/1998 Clusserath et al. ..... 141/101
6,575,216 B2 * 6/2003 Yang ..... 156/351

FOREIGN PATENT DOCUMENTS

DE 1 588 365 7/1970
DE 24 35 540 2/1976
DE 28 45 645 4/1980
DE 19911074 9/2000

* cited by examiner

*Primary Examiner*—Rinaldi I. Rada
*Assistant Examiner*—John Paradiso
(74) *Attorney, Agent, or Firm*—Nils H. Ljungman & Associates

(57) ABSTRACT

A beverage bottling plant for filling bottles with a liquid filling material with an adjustable labeling mechanism for labeling bottles, a and a method of operating a beverage bottling plant. The abstract of the disclosure is submitted herewith as required by 37 C.F.R. §1.72(b). As stated in 37 C.F.R. §1.72(b): A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims. Therefore, any statements made relating to the abstract are not intended to limit the claims in any manner and should not be interpreted as limiting the claims in any manner.

19 Claims, 4 Drawing Sheets

BEVERAGE BOTTLING PLANT FOR FILLING BOTTLES WITH A LIQUID FILLING MATERIAL WITH AN ADJUSTABLE LABELING MECHANISM FOR LABELING BOTTLES, AND A METHOD OF OPERATING A BEVERAGE BOTTLING PLANT

BACKGROUND

1. Technical Field

This present application relates to a beverage bottling plant for filling bottles with a liquid filling material having an adjustable labeling mechanism for labeling bottles, and a method of operating a beverage bottling plant. It accordingly includes rotary-type machines with rotating plates on which the containers stand, and with labeling stations that are located on the periphery of the rotor or can be attached or docked to it, linear machines or even horizontal rotors.

2. Background Information

A beverage bottling plant for filling bottles with a liquid beverage filling material can possibly comprise a beverage filling machine with a plurality of beverage filling positions, each beverage filling position having a beverage filling device for filling bottles with liquid beverage filling material. The filling devices may have an apparatus designed to introduce a predetermined volume of liquid beverage filling material into the interior of bottles to a substantially predetermined level of liquid beverage filling material. The apparatus designed to introduce a predetermined flow of liquid beverage filling material further comprises an apparatus that is designed to terminate the filling of the beverage bottles upon the liquid beverage filling material reaching the predetermined level in bottles. There may also be provided a conveyer arrangement that is designed to move bottles, for example, from an inspecting machine to the filling machine. Upon filling, a closing station closes the filled bottles. There may further be provided a conveyer arrangement configured to transfer filled bottles from the filling machine to the closing station. Bottles may be labeled in a labeling station, the labeling station having a conveyer arrangement to receive bottles and to output bottles. The closing station and the labeling station may be connected by a corresponding conveyer arrangement.

On rotary-type labeling machines (DE 28 45 645 B1), the prior art teaches that the entire labeling station, i.e. the carrier with the gripper cylinder as well as the label box and the glue roller or gum furret, can be rotated as a unit around the axis of the carrier. The different distances of the areas to be labeled from the labeling stations that result from the different sizes and formats of the objects to be labeled can be bridged by the displacement toward the path of transport of the objects of the path of circulation of the gripper and applicator elements related to their torque. However, problems are encountered in the transfer of labels from the gripper cylinder to the areas to be labeled, because these areas, on account of the equal angular velocity of the objects that are moving on a curved track past the labeling stations, when the paths of the areas to be labeled have different radii of curvature, are moving at a speed which is not the same as the speed of the grippers and in particular of the applicator elements. In other words, in the area where the labels are transferred to the objects, there is no synchronization between the areas to be labeled and the applicator elements. This problem is overcome by mounting the portion of the gripper cylinder that supports the applicator elements on the gripper cylinder axis by means of an adjustable cam.

The different distance of the areas to be labeled from the labeling station is taken into consideration on one hand by the rotation of the entire labeling station with respect to the bottle table and on the other hand by the adjustment of the cam of the part that supports the applicator elements, so that the path of circulation of the applicable elements is tangent to or intersects the path of the areas to be labeled at a slight angle. When large-diameter bottles are being labeled with short labels, however, problems are encountered in the transfer of the labels to the bottle, because the gripper element which is not adjusted by the cam does not put the label in the optimum position for the transfer. To compensate for this disadvantage, a control cam is provided for the radial displacement of each gripper element, on which a scanning mechanism that is associated with the gripper element is guided. For the adjustment to different bottle diameters, the prior art teaches still other solutions (DE-OS 15 86 365, DE 24 35 540 B2), that include an adjustment of the labeling station in the radial direction in relation to the midpoint of the bottle table.

The corresponding adjustment and adaptation of the labeling station is thereby done manually, and the result of the adjustment must be constantly verified by the operator or maintenance employee.

OBJECT OR OBJECTS

The object is to eliminate this problem and to indicate an improvement that simplifies such an adjustment of the labeling station and makes possible a more extensive adjustment or adaptation, including adjustments or adaptations in different planes to respond to different sets of problems and to perform different tasks.

SUMMARY

The present application teaches that this object can be accomplished by mounting at least the label transfer device by means of a transmission so that it can be moved and adjusted multi-dimensionally in the transfer space.

In an independent and self-sufficient realization of the present application, the labeling station is also mounted with the actual label transfer station by means of a transmission so that it can move multi-dimensionally in the three-dimensional space, with the unrestricted actuation of a pivot point that can be selected without restriction for the label transfer and/or for the orientation of the labeling station.

Additional features and developments of the embodiments are described herein below.

The present application offers scope for practically all different optimization variants that occur or are desirable for the labeling of different types of containers, in a form that is variable as well as reproducible and retrievable. The construction employed is also extremely simple because hardly any bending moments occur inside such a transmission in the form of a static three-dimensional framework.

In the context of the present application, the phrase "can move or be moved multi-dimensionally in the transfer space" is understood to mean that the transfer space and/or the movement in said space is defined by the three degrees of freedom of translation and the three degrees of freedom of rotation, and that the movement, e.g. of a labeling station, follows at least one axis of movement that corresponds to one of these degrees of freedom, whereby a movement in the majority of cases is composed of movement components that correspond to a plurality or even all the degrees of freedom.

The above-discussed embodiments of the present invention will be described further hereinbelow. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The embodiments are explained in greater detail below with reference to the exemplary embodiments illustrated in the accompanying drawings, in which.

DESCRIPTION OF EMBODIMENT OR EMBODIMENTS

Figure 1:
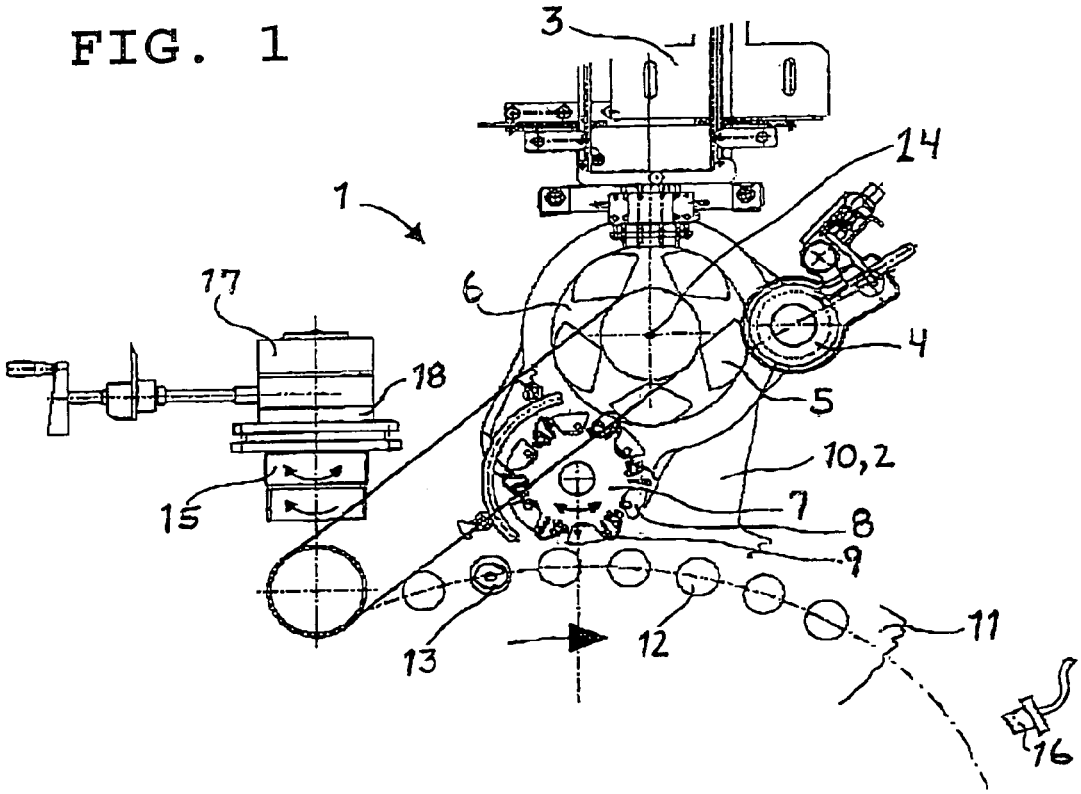
FIG. 1 is a labeling station of the prior art.
Figure 1A:
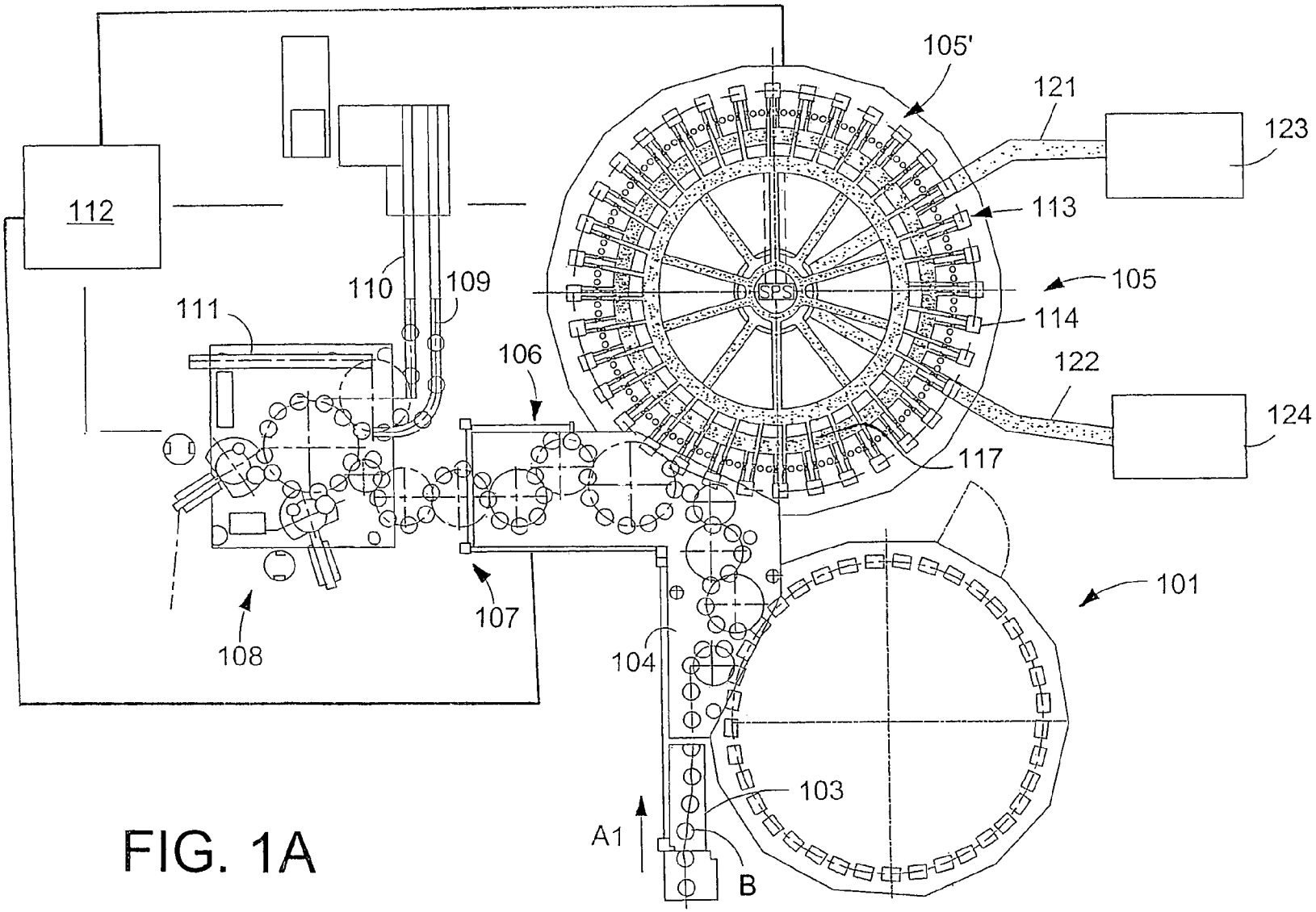
FIG. 1A is a schematic illustration of a container filling plant in accordance with one possible embodiment.

FIG. 1A shows schematically the main components of one possible embodiment example of a system for filling containers, specifically, a beverage bottling plant for filling bottles B with at least one liquid beverage, in accordance with at least one possible embodiment, in which system or plant could possibly be utilized at least one aspect, or several aspects, of the embodiments disclosed herein.

FIG. 1A shows a rinsing arrangement or rinsing station 101, to which the containers, namely bottles B, are fed in the direction of travel as indicated by the arrow A1, by a first conveyer arrangement 103, which can be a linear conveyor or a combination of a linear conveyor and a starwheel. Downstream of the rinsing arrangement or rinsing station 101, in the direction of travel as indicated by the arrow A1, the rinsed bottles B are transported to a beverage filling machine 105 by a second conveyer arrangement 104 that is formed, for example, by one or more starwheels that introduce bottles B into the beverage filling machine 105.

The beverage filling machine 105 shown is of a revolving or rotary design, with a rotor 105', which revolves around a central, vertical machine axis. The rotor 105' is designed to receive and hold the bottles B for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles B to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 1A, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle B, the first product or the second product can be filled by means of an appropriate control of the filling product or fluid valves.

Downstream of the beverage filling machine 105, in the direction of travel of the bottles B, there can be a beverage bottle closing arrangement or closing station 106 which closes or caps the bottles B. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles B. In the embodiment shown, the labeling arrangement 108 has three output conveyer arrangement: a first output conveyer arrangement 109, a second output conveyer arrangement 110, and a third output conveyer arrangement 111, all of which convey filled, closed, and labeled bottles B to different locations.

The first output conveyer arrangement 109, in the embodiment shown, is designed to convey bottles B that are filled with a first type of liquid beverage supplied by, for example, the supply reservoir 123. The second output conveyer arrangement 110, in the embodiment shown, is designed to convey bottles B that are filled with a second type of liquid beverage supplied by, for example, the supply reservoir 124. The third output conveyer arrangement 111, in the embodiment shown, is designed to convey incorrectly labeled bottles B. To further explain, the labeling arrangement 108 can comprise at least one beverage bottle inspection or monitoring device that inspects or monitors the location of labels on the bottles B to determine if the labels have been correctly placed or aligned on the bottles B. The third output conveyer arrangement 111 removes any bottles B which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

The labeling station represented by the illustrated exemplary embodiment is designed for the transfer of individual labels to containers such as bottles, cans and similar objects. The configuration taught by the present application, however, is also appropriate for other types of labeling stations and machines and can also be used on them. Consequently, labeling stations for endless labels, film, plastic strip or self-adhesive labels and similar types of labels can also be configured as taught by the present application, including stations for the labeling of a roll with a label that runs part way or all the way around, whereby the configuration taught by the invention can also be used for the labeling of boxes, crates or other types of packages.

The apparatus illustrated in FIG. 1 for feeding labels in labeling machines for bottles, for example, comprises a labeling unit or station 1 which is located on a supporting table 2, 10. The labeling unit has a label container 3, an adhesive roller 4, a rotating carrier 6 that is provided with gluable extraction segments 5 and a gripper cylinder 7.

The gripper cylinder 7 is driven by a transmission and for multiple labeling comprises two cylinders that are located one above the other with applicator elements 8 and gripper fingers 9. On the rotating bottle table 11 there are, at a small distance from each other, bottle plates 12 on which the bottles 13 are transported past the gripper cylinder 7. Because the distance between the bottle plates 12 is less than the distance between the gripper cylinders 7, an additional rotation of the bottle 13 is necessary during the labeling process. To be able to use short labels, i.e. labels that are short in relation to the bottle diameter, and to achieve labeling of the desired quality even when multiple labels are being applied to non-cylindrical portions of the bottle, the labeling unit 1 is also installed so that it can pivot continuously around the center axis 14.

The extraction segments 5 and the gripper cylinder can also be adjusted in terms of their position with respect to the stationary parts 3, 4 of the labeling station. For this purpose there is a differential transmission 15 and/or a cross-slide which is not illustrated in any further detail, on which the entire station is mounted so that it can be moved crosswise. In the discharge area of the labeled bottles, for example at the end of the rotation by the bottle table 11 or downstream of an outlet star wheel (not shown), there is a label position control device 16, by means of which the desired location of the labels on the bottles is monitored. When the label position varies from the desired position by more than the specified tolerances, the position control device transmits corresponding signals to actuate a motor-driven correction device 17 to move the labeling station 1 and/or to synchronize the gripper cylinder 7 and the extraction segment 5. Both a cross-slide, if one is present, and a drive transmission 18 for the labeling station can thereby be actuated as appropriate and the position of the labeling station can be changed.

Figure 1B:
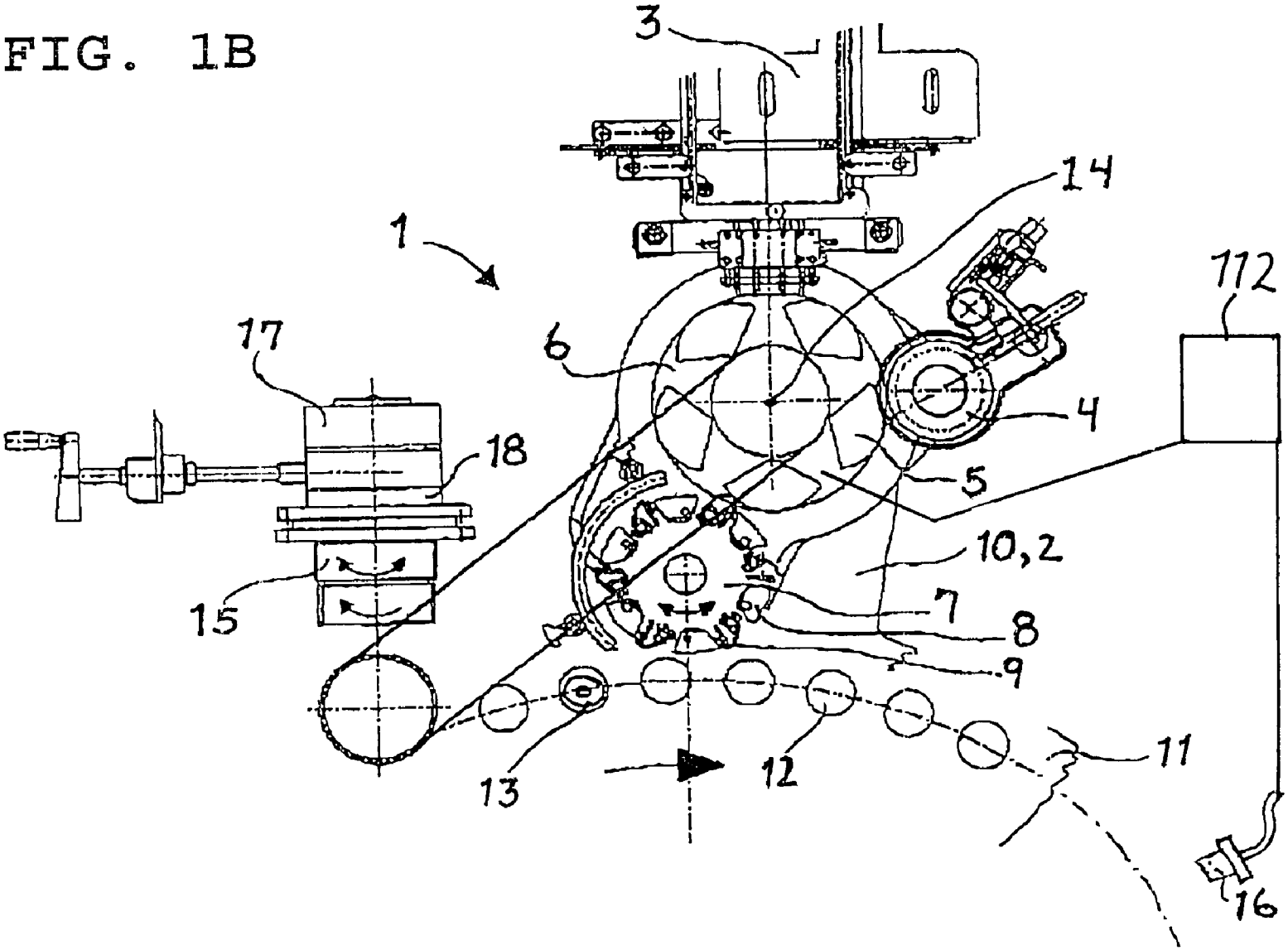
FIG. 1B shows a labeling station with a computer control according to one possible embodiment.
Figure 3:
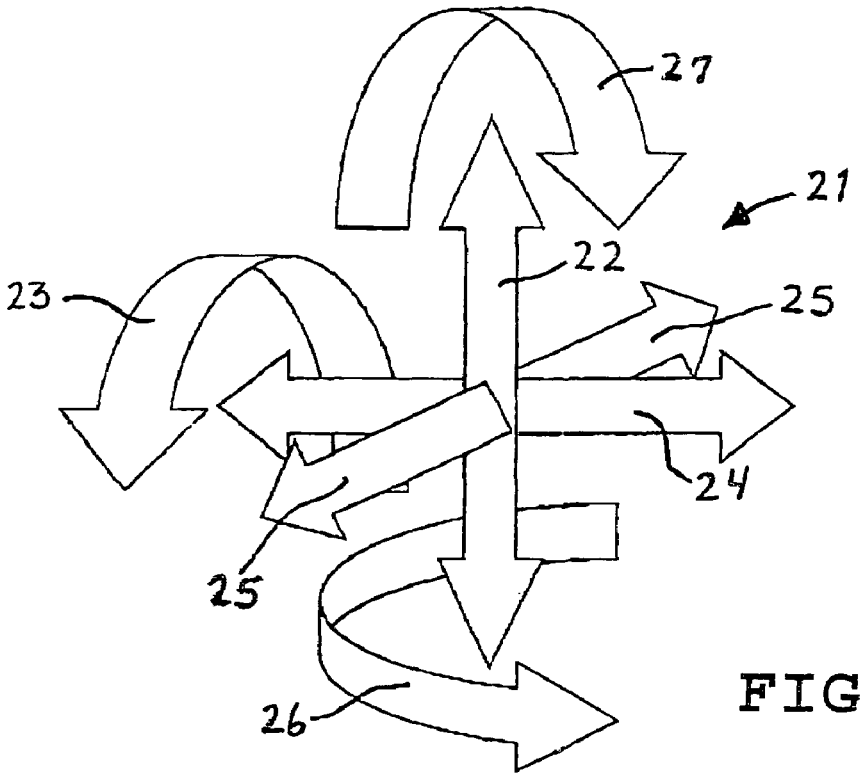
FIG. 3 illustrates the different movement variants of such a labeling station.

As illustrated in FIG. 1B, in one possible embodiment the label position control device 16 and the labeling station 1 may be connected to the central control arrangement 112 that controls the beverage bottling plant. In another possible embodiment, the label position control device 16 and the labeling station 1 may possibly connected to their own separate computer.

In one possible embodiment, the label position control device 16 may be an imaging device configured and disposed to transmit images of bottles being labeled to the central control arrangement 112. Once the central control arrangement 112 receives the images from the label position control device, it may evaluate the position of the labels on the bottles. If there has been an error in the application of a label on a bottle, for instance, if the label is positioned incorrectly or if the label was not completely applied smoothly, the central control arrangement 112 may transmit a signal to the labeling station 1 in order to correct the label application error. At this point, the transmission 19 may be actuated to move the labeling station 1, and/or the motor driven correction device 17 may be actuated to adjust the rotating carrier 6.

Figure 2:
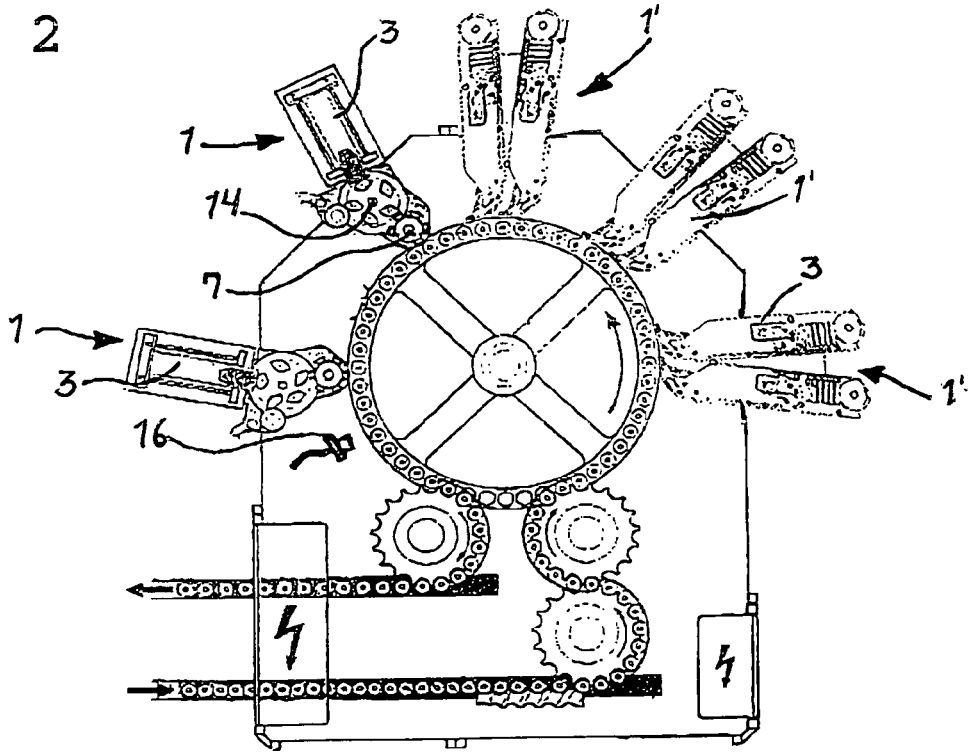
FIG. 2 is a labeling machine with a plurality of different labeling stations.

Labeling stations 1, 1' of this type designed for the types of labels and containers described above can be installed in different numbers and sequences on the turning circle of a labeling machine of the type illustrated in FIG. 2, or can be otherwise installed, attached, docked or connected with such machines. One advantageous use of such a labeling machine, for example, is also on linear machines, labeling machines for the labeling of large containers, cardboard boxes etc.

Figure 4:
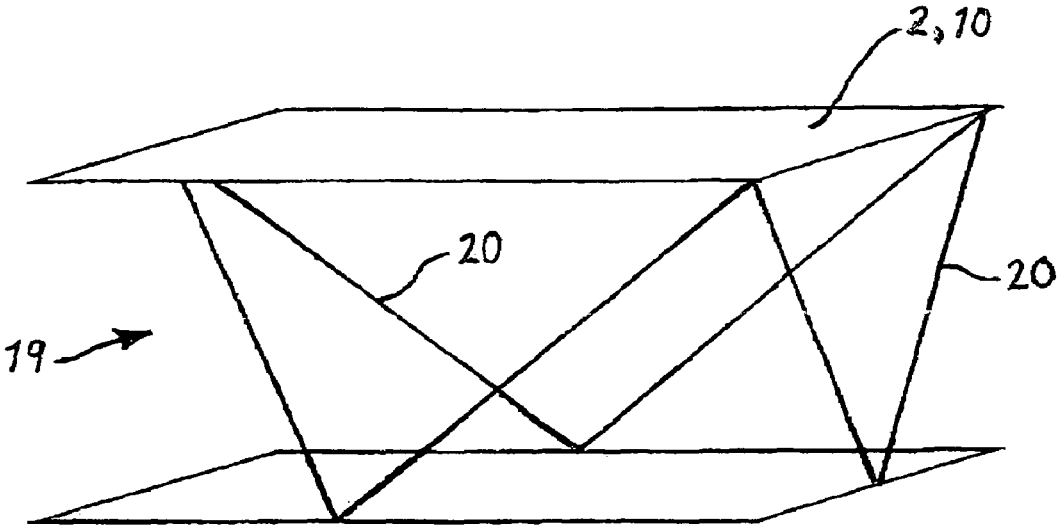
FIG. 4 shows one possible realization and layout of the configuration taught by one possible embodiment.

The labeling station 1 or at least its labeling transfer device is advantageously located on a machine table 2, 10, as in the exemplary embodiment illustrated in FIG. 4. For its part, the machine table 2, 10 has a transmission 19 with a plurality of actuator motors or motor-driven, variable-length adjustment arms 20, which can be or set in the desired or necessary position or actuated to bring about the desired or necessary position changes by the above mentioned control system, which is not described in any further detail and which can include, for example, a digital signal processor to bring about the desired or necessary position change. In this manner, the labeling station 1 can be moved multi-dimensionally in the space with the unrestricted selection of an optimal point for the transfer of the labels. The specified or selected position of the space axes 21 for the optimal transport of the labels and their subsequent transfer to the periphery or cylindrical surface of the container can be located without restriction in the three-dimensional space, and it can be changed or corrected, preferably by means of a software command, for each transfer process and/or in the event of a change in the labeling of the container, i.e. when there is a change of the labels to be processed. In particular, once the transfer criteria and positions have been optimized in relation to the different containers and similar objects and to their surfaces, said criteria and positions can be retrieved and reproduced. Consequently, the changeover to other types of containers and to other sizes of containers can be done easily by entering the respective container type. Depending on the constructive configuration, the transmission 19 can also be connected directly with the labeling station 1 or can be located on it. Preferably the space axes 21 for the movements up-down 22, forward-backward 24, left-right 25, tipping in the right and left plane 23, tilting forward and backward 27 and rotation around the vertical axis 26 can be oriented and actuated by means of the transmission 19. Optimal adjustment capabilities for the correct positioning of the label can be achieved by locating the labeling station and/or at least one of the label transfer devices on a parallel kinematic adjustment device or transmission 19 using the hexapod system. To determine the respective three-dimensional position of the labeling station with respect to the respective transfer position, position transducers that respond to either position or distance can be provided. These position transducers can also be used for the detection and determination of the beginning and ending positions to be set.

The movement commands are preferably input in the form of object coordinates with reference to the container, or in the form of commands that represent the movements in one of the 6 space axes with reference to a freely selected pivot point, e.g. the pivoting of a labeling station in a horizontal plane around a vertical axis, whereby said vertical axis corresponds, for example, to the vertical axis of the container to be labeled.

The movement commands entered are then converted, for example by real-time transformation, into corresponding sequences of movement for the individual axes or shafts of the transmission 19, and therefore for the individual axes or shafts of a hexapod transmission, whereby in the context of the determination of the individual sequences of movement, said sequences of movement are preferably determined so that the orientation of the labeling station changes only in the desired manner, and the orientation in the other space axes and/or degrees of freedom remains unchanged.

In another configuration, for the determination of the optimum application forces for a smooth transfer of the labels, the label transfer station also has load sensors. The labeling station 1 can also be located with the parallel kinematic adjustment system on a controlled longitudinal slide or cross-slide, so that additional axes of movement are available to make rapid adjustments.

For the verification that the labels have been applied in the correct position, a control device 16 as described above can also be provided, by means of which the labeling results achieved can be checked and analyzed. If variances of the labeling from the specified position are detected, the analysis results can also be used for the direct or indirect actuation of the transmission (19) to achieve the desired result by correcting the position of the labeling station, for example.

In place of the transmission realization described above and illustrated in the accompanying drawings, the teaching of the present application also includes the use of transmissions (19) with a smaller or larger number of axes for the movement and orientation of the labeling stations (1, 1'), whereby for example movement in two or three planes can be actuated and the labeling station can be oriented accordingly. Depending on the task to be performed and the degree of difficulty of the individual labeling problem being addressed, instructions can be given for the apparatus to execute a movement in rotation and/or translation, each for three degrees of freedom, for example, whereby it becomes possible to make adjustments and adaptations of such a labeling station in any desired axis and by any desired dimension. The actuation and specified movements are thereby advantageously specified, whereby the movement in rotation or translation can be actuated and adapted independently of each other to meet the requirements of the labeling tasks or problems associated with these planes of movement.

On labeling machines with identical and/or different labeling stations that are interchangeable and/or can be docked in different positions, as described in DE 199 11 074 A1, for example, the transmission (19) itself is realized, for cost reasons among other things, as part of the respective labeling machine. Consequently a plurality of labeling stations can be economically kept on hand in a simple realization, i.e. without a transmission (19). In that case, the labeling station (1, 1') that is used can be connected with the transmission (19) by means of a quick-release coupling or in another suitable manner. To adapt the equipment so that it can be used for all conceivable labeling tasks, the transmission (19) is advantageously realized in the form of a unit, the position of which can be changed, which is located on the periphery of such a labeling machine. The transmission (19) can also be realized in the form of a unit that is movable and can be fixed and/or docked in different positions to assume the labeling positions currently required.

The present application relates to a labeling machine for the application of labels to peripheral surfaces of containers such as bottles, cans, cardboard boxes and similar objects with a plane of movement and transport for the containers, an associated transfer area for the application of the labels to the containers and a labeling station with label transfer and label storage devices, whereby at least the label transfer device is mounted so that it can be moved and adjusted multi-dimensionally in a three-dimensional space by means of a transmission.

One feature or aspect of an embodiment is believed at the time of the filing of this patent application to possibly reside broadly in a labeling machine for the application of labels to peripheral surfaces of containers such as bottles, cans, cardboard boxes and similar objects with a plane of movement and transport for the containers, an associated transfer area for the application of the labels to the containers and a labeling station with label transfer and label storage devices, characterized by the fact that at least the label transfer device is mounted so that it can be moved and adjusted multi-dimensionally in a three-dimensional space by means of a transmission.

Another feature or aspect of an embodiment is believed at the time of the filing of this patent application to possibly reside broadly in a labeling machine with a labeling station located on a machine table, characterized by the fact that the labeling station with the actual label transfer device is mounted so that it can be moved without restriction and multi-dimensionally by means of a transmission with at least two planes of movement in the three-dimensional space to a selected transfer position that is optimal for the transfer of the labels.

Yet another feature or aspect of an embodiment is believed at the time of the filing of this patent application to possibly reside broadly in a labeling machine, characterized by the fact that the set or selected position of the space axes for the label transport and their transfer in three-dimensional space can be selected, modified and corrected by software commands, without restriction and reproducibly.

Still another feature or aspect of an embodiment is believed at the time of the filing of this patent application to possibly reside broadly in a labeling machine, characterized by the fact that the labeling station can be oriented and actuated at least with its space axes by means of an associated transmission, preferably for the movements up-down, forward-backward, left-right, tipping in a left and right plane, tilting forward and backward and rotation around the vertical axis.

A further feature or aspect of an embodiment is believed at the time of the filing of this patent application to possibly reside broadly in a labeling machine, characterized by the fact that the labeling station can be actuated for the additional movements: rotation around a vertical axis, preferably in the center of the station, and laterally left and right.

Another feature or aspect of an embodiment is believed at the time of the filing of this patent application to possibly reside broadly in a labeling machine, characterized by the fact that the labeling station is motor-driven so that it can move in a plurality of planes in or on a machine frame and/or machine table.

Yet another feature or aspect of an embodiment is believed at the time of the filing of this patent application to possibly reside broadly in a labeling machine, characterized by the fact that the labeling station can be actuated so that it moves as an independent unit in a plurality of planes.

Still another feature or aspect of an embodiment is believed at the time of the filing of this patent application to possibly reside broadly in a labeling machine, characterized by the fact that the labeling station preferably has three degrees of freedom of movement in rotation.

A further feature or aspect of an embodiment is believed at the time of the filing of this patent application to possibly reside broadly in a labeling machine, characterized by the fact that the labeling station preferably has three degrees of freedom of movement in translation.

Another feature or aspect of an embodiment is believed at the time of the filing of this patent application to possibly reside broadly in a labeling machine, characterized by the fact that the labeling station is mounted on a six-axis adjustment device.

Another feature or aspect of an embodiment is believed at the time of the filing of this patent application to possibly reside broadly in a labeling machine, characterized by the fact that labeling station and/or at least the label transfer station is mounted on a parallel kinematic adjustment system.

Yet another feature or aspect of an embodiment is believed at the time of the filing of this patent application to possibly reside broadly in a labeling machine, characterized by the fact that the parallel kinematic adjustment system is realized in the form of a hexapod system.

Still another feature or aspect of an embodiment is believed at the time of the filing of this patent application to possibly reside broadly in a labeling machine as claimed in the preceding claims, characterized by the fact that the adjustment devices are actuator motors.

A further feature or aspect of an embodiment is believed at the time of the filing of this patent application to possibly reside broadly in a labeling machine, characterized by the fact that for the determination of the respective three-dimensional position of the labeling station with respect to the transfer position and/or its starting and ending position, there are position transducers that relate to space and/or distance.

Another feature or aspect of an embodiment is believed at the time of the filing of this patent application to possibly reside broadly in a labeling machine, characterized by the fact that that desired and/or correct label position is monitored by means of a label position control device, and the signal from said device is analyzed so that it actuates the adjustment devices of the labeling station, to correct its position and/or its speed of operation.

Yet another feature or aspect of an embodiment is believed at the time of the filing of this patent application to possibly reside broadly in a labeling machine, characterized by the fact that the movement commands are preferably entered in the form of object coordinates that are referenced to the containers or in movement commands that are referenced to the axes in three-dimensional space.

Still another feature or aspect of an embodiment is believed at the time of the filing of this patent application to possibly reside broadly in a labeling machine, characterized by the fact that the object coordinates and/or movement commands referenced to the axes in three-dimensional space can be converted into corresponding movement commands for the axis coordinates by a real-time transformation.

A further feature or aspect of an embodiment is believed at the time of the filing of this patent application to possibly reside broadly in a labeling machine, characterized by the fact that a controlled slide/cross-slide is provided underneath or above it, in addition to or as well as underneath or above the working area of a hexapod and transmission system.

Another feature or aspect of an embodiment is believed at the time of the filing of this patent application to possibly reside broadly in a labeling machine, characterized by the fact that associated with the label transfer device is a load sensor that specifies the optimal transfer position and/or the application pressure.

Yet another feature or aspect of an embodiment is believed at the time of the filing of this patent application to possibly reside broadly in a labeling machine, characterized by the fact that in a labeling machine with interchangeable and/or dockable labeling stations, the transmission itself is realized as part of the labeling machine and can be connected with a labeling station.

Still another feature or aspect of an embodiment is believed at the time of the filing of this patent application to possibly reside broadly in a labeling machine, characterized by the fact that the transmission is realized in the form of a variable-position unit on the periphery or in a linear section of the labeling machine.

A further feature or aspect of an embodiment is believed at the time of the filing of this patent application to possibly reside broadly in a labeling machine, characterized by the fact that the transmission is realized in the form of a unit that can be moved on the labeling machine, and can be fixed and/or docked in different positions.

Another feature or aspect of an embodiment is believed at the time of the filing of this patent application to possibly reside broadly in a labeling machine, characterized by the fact that a plurality of transmissions are located on the periphery or in a linear section of such labeling machines.

Still another feature or aspect of an embodiment is believed at the time of the filing of this patent application to possibly reside broadly in a beverage bottling plant for filling beverage bottles with liquid beverage material, said beverage bottling plant comprising: a beverage bottle cleaning machine being configured and disposed to clean beverage bottles; a feed arrangement to supply beverage bottles to said beverage bottle cleaning machine; a beverage filling machine being configured and disposed to fill beverage bottles with liquid beverage material; said beverage filling machine comprising a plurality of beverage filling devices for filling beverage bottles with liquid beverage material; at least one storage unit being configured and disposed to store a supply of liquid beverage material; at least one supply line being configured and disposed to connect said at least one storage unit to said beverage filling machine to supply liquid beverage material to said beverage filling machine; a first conveyer arrangement being configured and disposed to move beverage bottles from said beverage bottle cleaning machine into said beverage filling machine; said first conveyer arrangement comprising a star wheel structure; a beverage bottle closing machine being configured and disposed to close tops of filled beverage bottles; a second conveyer arrangement being configured and disposed to move filled beverage bottles from said beverage filling machine into said beverage bottle closing machine; said second conveyer arrangement comprising a star wheel structure; a beverage bottle labeling station being configured and disposed to label filled, closed beverage bottles; a third conveyor arrangement being configured and disposed to move filled, closed beverage bottles from said beverage bottle closing machine into said beverage bottle labeling station; said third conveyer arrangement comprising a star wheel structure; a beverage bottle packing station being configured and disposed to package labeled, filled, closed beverage bottles; a fourth conveyor arrangement being configured and disposed to move labeled, filled, closed beverage bottles from said beverage bottle labeling station to said beverage bottle packing station; said fourth conveyer arrangement comprising a linear conveyor structure being configured and disposed to arrange beverage bottles in groups for packing; a computer control system being configured and disposed to monitor and control operation of said beverage bottling plant; said beverage bottle labeling station comprising: a rotary bottle carrier; said rotary bottle carrier comprising individual bottle platforms disposed about the periphery of said rotary bottle carrier; at least one beverage bottle labeling machine; said at least one beverage bottle labeling machine being disposed adjacent said rotary bottle carrier and being configured and disposed to attach labels to bottles on said individual bottle platforms; a label position control device being disposed adjacent said rotary bottle carrier, and being configured to inspect labeled bottles to monitor the position and smoothness of labels on bottles and transmit inspection data to said computer control system; and said beverage bottle labeling machine comprising: a label supply container being configured and disposed to contain a supply of labels; a rotary label carrier being configured and disposed to remove labels from said label supply container; an adhesive roller being configured and disposed to apply adhesive to labels; a gripper cylinder being configured and disposed to receive labels from said rotary label carrier and attach labels to bottles; a support table structure; said label supply container, said rotary label carrier, said adhesive roller, and said gripper cylinder each being mounted on said support table structure; said support table structure comprising a motorized transmission arrangement; and said motorized transmission arrangement being configured and disposed to move said support table structure multi-dimensionally in a three-dimensional space to adjust the position of said labeling machine to permit correct attachment of labels on bottles upon said label position control device detecting an error in the attachment of labels, or upon a change in the type of labels being used or the type of bottles being labeled.

Another feature or aspect of an embodiment is believed at the time of the filing of this patent application to possibly reside broadly in a method of operating a beverage bottling plant for filling beverage bottles with liquid beverage material, said beverage bottling plant comprising: a beverage bottle cleaning machine being configured and disposed to clean beverage bottles; a feed arrangement to supply beverage bottles to said beverage bottle cleaning machine; a beverage filling machine being configured and disposed to fill beverage bottles with liquid beverage material; said beverage filling machine comprising a plurality of beverage filling devices for filling beverage bottles with liquid beverage material; at least one storage unit being configured and disposed to store a supply of liquid beverage material; at least one supply line being configured and disposed to connect said at least one storage unit to said beverage filling machine to supply liquid beverage material to said beverage filling machine; a first conveyer arrangement being configured and disposed to move beverage bottles from said beverage bottle cleaning machine into said beverage filling machine; said first conveyer arrangement comprising a star wheel structure; a beverage bottle closing machine being configured and disposed to close tops of filled beverage bottles; a second conveyer arrangement being configured and disposed to move filled beverage bottles from said beverage filling machine into said beverage bottle closing machine; said second conveyer arrangement comprising a star wheel structure; a beverage bottle labeling station being configured and disposed to label filled, closed beverage bottles; a third conveyor arrangement being configured and disposed to move filled, closed beverage bottles from said beverage bottle closing machine into said beverage bottle labeling station; said third conveyer arrangement comprising a star wheel structure; a beverage bottle packing station being configured and disposed to package labeled, filled, closed beverage bottles; a fourth conveyor arrangement being configured and disposed to move labeled, filled, closed beverage bottles from said beverage bottle labeling station to said beverage bottle packing station; said fourth conveyer arrangement comprising a linear conveyor structure being configured and disposed to arrange beverage bottles in groups for packing; a computer control system being configured and disposed to monitor and control operation of said beverage bottling plant; said beverage bottle labeling station comprising: a rotary bottle carrier; said rotary bottle carrier comprising individual bottle platforms disposed about the periphery of said rotary bottle carrier; at least one beverage bottle labeling machine; said at least one beverage bottle labeling machine being disposed adjacent said rotary bottle carrier and being configured and disposed to attach labels to bottles on said individual bottle platforms; a label position control device being disposed adjacent said rotary bottle carrier, and being configured to inspect labeled bottles to monitor the position and smoothness of labels on bottles and transmit inspection data to said computer control system; and said beverage bottle labeling machine comprising: a label supply container being configured and disposed to contain a supply of labels; a rotary label carrier being configured and disposed to remove labels from said label supply container; an adhesive roller being configured and disposed to apply adhesive to labels; a gripper cylinder being configured and disposed to receive labels from said rotary label carrier and attach labels to bottles; a support table structure; said label supply container, said rotary label carrier, said adhesive roller, and said gripper cylinder each being mounted on said support table structure; said support table structure comprising a motorized transmission arrangement; and said motorized transmission arrangement being configured and disposed to move said support table structure multi-dimensionally in a three-dimensional space to adjust the position of said labeling machine to permit correct attachment of labels on bottles upon said label position control device detecting an error in the attachment of labels, or upon a change in the type of labels being used or the type of bottles being labeled, said method comprising the steps of: supplying beverage bottles to said beverage bottle cleaning machine; cleaning beverage bottles; transporting beverage bottles to said beverage filling machine; filling beverage bottles with liquid beverage material; transporting filled beverage bottles to said beverage bottle closing machine; closing tops of filled beverage bottles; transporting filled beverage bottles to said beverage bottle labeling station; attaching labels onto filled beverage bottles with said beverage bottle labeling machine; inspecting labeled bottles with said label position control device; activating said motorized transmission arrangement to move said support table structure multi-dimensionally in a three-dimensional space to adjust the position of said labeling machine to permit correct attachment of labels on bottles upon said label position control device detecting an error in the attachment of labels, or upon a change in the type of labels being used or the type of bottles being labeled; transporting filled beverage bottles to said beverage bottle packing station; arranging filled beverage bottles into groups of beverage bottles; packing groups of beverage bottles.

Some examples of measuring or sensor devices for measuring 6 degree-of-freedom motion which may possibly be utilized or adapted for use in at least one possible embodiment may possibly be found in the following U.S. Pat. No. 6,459,092, entitled "6 degree-of-freedom (DOF) motion measuring apparatus;" and U.S. Pat. No. 6,848,304, entitled "Six degree-of-freedom micro-machined multi-sensor."

Some examples of devices for transmitting movement in six degrees-of-freedom which may possibly be utilized or adapted for use in at least one possible embodiment may possibly be found in the following U.S. Pat. No. 6,543,740, entitled "Mechanism for transmitting movement in up to six degrees-of-freedom;" U.S. Pat. No. 6,246,390, entitled "Multiple degree-of-freedom mechanical interface to a computer system;" U.S. Pat. No. 5,784,542, entitled "Decoupled six degree-of-freedom teleoperated robot system;" and U.S. Pat. No. 5,160,877, entitled "Multiple degree-of-freedom positioning device."

The components disclosed in the various publications, disclosed or incorporated by reference herein, may possibly be used in possible embodiments of the present invention, as well as equivalents thereof.

Some examples of bottling systems, which may be used or adapted for use in at least one possible embodiment of the present may be found in the following U.S. Patents assigned to the Assignee herein, namely: U.S. Pat. Nos. 4,911,285; 4,944,830; 4,950,350; 4,976,803; 4,981,547; 5,004,518; 5,017,261; 5,062,917; 5,062,918; 5,075,123; 5,078,826; 5,087,317; 5,110,402; 5,129,984; 5,167,755; 5,174,851; 5,185,053; 5,217,538; 5,227,005; 5,413,153; 5,558,138; 5,634,500; 5,713,403; 6,276,113; 6,213,169; 6,189,578; 6,192,946; 6,374,575; 6,365,054; 6,619,016; 6,474,368; 6,494,238; 6,470,922; and U.S. Pat. No. 6,463,964.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

Some examples of stepping motors that may possibly be utilized or possibly adapted for use in at least one possible embodiment of the present application may possibly be found in the following U.S. Pat. No. 6,348,774 issued to Andersen et al. on Feb. 19, 2002; U.S. Pat. No. 6,373,209 issued to Gerber et al. on Apr. 16, 2002; U.S. Pat. No. 6,424,061 issued to Fukuda et al. on Jul. 23, 2002; U.S. Pat. No. 6,509,663 issued to Aoun on Jan. 21, 2003; U.S. Pat. No. 6,548,923 to Ohnishi et al. on Apr. 15, 2003; and U.S. Pat. No. 6,661,193 issued to Tsai on Dec. 9, 2003.

The appended drawings in their entirety, including all dimensions, proportions and/or shapes in at least one embodiment of the invention, are accurate and are hereby included by reference into this specification.

Some examples of servo-motors that may possibly be utilized or possibly adapted for use in at least one possible embodiment of the present application may possibly be found in the following U.S. Pat. No. 4,050,434 issued to Zbikowski et al. on Sep. 27, 1977; U.S. Pat. No. 4,365,538 issued to Andoh on Dec. 28, 1982; U.S. Pat. No. 4,550,626 issued to Brouter on Nov. 5, 1985; U.S. Pat. No. 4,760,699 issued to Jacobsen et al. on Aug. 2, 1988; U.S. Pat. No. 5,076,568 issued to de Jong et al. on Dec. 31, 1991; and No. 6,025 issued to Yasui on Feb. 15, 2000.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Some examples of synchronous motors which may possibly be utilized or adapted for use in at least one possible embodiment may possibly be found in the following U.S. Pat. No. 6,713,899, entitled "Linear synchronous motor;" U.S. Pat. No. 6,486,581, entitled "Interior permanent magnet synchronous motor;" U.S. Pat. No. 6,424,114, entitled "Synchronous motor;" U.S. Pat. No. 6,388,353, entitled "Elongated permanent magnet synchronous motor;" U.S. Pat. No. 6,329,728, entitled "Cylinder-type linear synchronous motor;" U.S. Pat. No. 6,025,659, entitled "Synchronous motor with movable part having permanent magnets;" U.S. Pat. No. 5,936,322, entitled "Permanent magnet type synchronous motor;" and U.S. Pat. No. 5,448,123, entitled "Electric synchronous motor."

All, or substantially all, of the components and methods of the various embodiments may be used with at least one embodiment or all of the embodiments, if more than one embodiment is described herein.

Some examples of laser printing arrangements that may possibly be utilized or possibly adapted for use in at least one possible embodiment of the present application may possibly be found in the following U.S. Pat. No. 4,847,643 issued to Ohmori on Jul. 11, 1989; U.S. Pat. No. 5,294,945 issued to Omura et al. on Mar. 15, 1994; U.S. Pat. No. 5,528,280 issued to Endo et al. on Jun. 18, 1996; U.S. Pat. No. 6,210,778 issued to Poirier et al. on Apr. 3, 2001; U.S. Pat. No. 6,433,810 issued to Katayama et al. on Aug. 13, 2002; and U.S. Pat. No. 6,655,275 issued to Mugrauer on Dec. 2, 2003.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

Some examples of ink jet printing apparatus and methods that may possibly be utilized or possibly adapted for use in at least one possible embodiment of the present application may possibly be found in the following U.S. Pat. No. 6,582,047 issued to Koitabashi et al. on Jun. 24, 2003; U.S. Pat. No. 6,623,093 issued to Takahashi et al. on Sep. 23, 2003; U.S. Pat. No. 6,625,351 issued to Cox et al. on Sep. 23, 2003; U.S. Pat. No. 6,652,055 issued to Oikawa on Nov. 25, 2003; U.S. Pat. No. 6,669,767 issued to Blease et al. on Dec. 30, 2003; and U.S. Pat. No. 6,688,739 issued to Murray on Feb. 10, 2004.

All of the patents, patent applications and publications recited herein, and in the Declaration attached hereto, are hereby incorporated by reference as if set forth in their entirety herein.

Some examples of screen printing apparatus that may possibly be utilized or possibly adapted for use in at least one possible embodiment of the present application may possibly be found in the following U.S. Pat. No. 5,374,449 issued to Bühlmann et al. on Dec. 20, 1994; U.S. Pat. No. 5,722,321 issued to Szyszko et al. on Mar. 3, 1998; U.S. Pat. No. 6,591,745 issued to Miyahara et al. on Jul. 15, 2003; U.S. Pat. No. 6,601,502 issued to Kamen et al. on Aug. 5, 2003; U.S. Pat. No. 6,619,197 issued to Murakami et al. on Sep. 16, 2003; and U.S. Pat. No. 6,659,005 issued to Takahashi et al. on Dec. 9, 2003.

Some examples of bottling and container handling systems and components thereof which may possibly be utilized or adapted for use in at least one possible embodiment, may possibly be found in the following U.S. Pat. No. 6,484,477, entitled "Capping Machine for Capping and Closing Containers, and a Method for Closing Containers;" U.S. Pat. No. 6,474,368, entitled "Beverage Container Filling Machine, and Method for Filling Containers with a Liquid Filling Material in a Beverage Container Filling Machine;" U.S. Pat. No. 6,494,238, entitled "A Plant for Filling Beverage into Beverage Bottles Other Beverage Containers Having Apparatus for Replacing Remaining Air Volume in Filled Beverage Bottles or Other Beverage Containers;" U.S. Pat. No. 6,470,922, entitled "Apparatus for the Recovery of an Inert Gas;" U.S. Pat. No. 6,463,964, entitled "Method of Operating a Plant for Filling Bottles, Cans or the like Beverage Containers with a Beverage, and a Beverage Container Filling Machine;" U.S. Pat. No. 6,834,473, entitled "Bottling Plant and Method of Operating a Bottling Plant and a Bottling Plant with Sections for Stabilizing the Bottled Product;" U.S. Pat. No. 6,484,762, entitled "A Filling System with Post-dripping Prevention;" and U.S. Pat. No. 6,668,877, entitled "Filling System for Still Beverages."

Some examples of bottling and container handling systems and components thereof which may possibly be utilized or adapted for use in at least one possible embodiment, may possibly be found in the following U.S. patent applications: Ser. No. 10/653,617, filed on Sep. 2, 2003, having, entitled "Labeling Machine with a Sleeve Mechanism for Preparing and Applying Cylindrical Labels onto Beverage Bottles and Other Beverage Containers in a Beverage Container Filling Plant;" Ser. No. 10/666,931, filed on Sep. 18, 2003, having, entitled "Beverage Bottling Plant for Filling Bottles with a Liquid Beverage Filling Material and a Labelling Station for Filled Bottles and Other Containers;" Ser. No. 10/723,451, filed on Nov. 26, 2003, having, entitled "Beverage Bottling Plant for Filling Beverage Bottles or Other Beverage Containers with a Liquid Beverage Filling Material and Arrangement for Dividing and Separating of a Stream of Beverage Bottles or Other Beverage Containers;" Ser. No. 10/739,895, filed on Dec. 18, 2003, having, entitled "Method of Operating a Beverage Container Filling Plant with a Labeling Machine for Labeling Beverage Containers Such as Bottles and Cans, and a Beverage Container Filling Plant with a Labeling Machine for Labeling Beverage Containers Such as Bottles and Cans;" Ser. No. 10/756,171, filed on Jan. 13, 2004, having entitled "A Beverage Bottling Plant for Filling Bottles and like Containers with a Liquid Beverage Filling Material and a Conveyer Arrangement for Aligning and Distributing Packages Containing Filled Bottles and like Containers;" Ser. No 10/780,280, entitled "A Beverage Bottling Plant for Filling Bottles with a Liquid Beverage Filling Material, a Container Filling Plant Container Information Adding Station, Such As, a Labeling Station, Configured to Add Information to Containers, Such As, Bottles and Cans, and Modules for Labeling Stations;" Ser. No. 10/786,256, entitled "A Beverage Bottling Plant for Filling Bottles with a Liquid Beverage Filling Material, and a Container Filling Lifting Device for Pressing Containers to Container Filling Machines;" Ser. No. 10/793,659, entitled "A Beverage Bottling Plant for Filling Bottles with a Liquid Beverage Filling Material, and a Container Filling Plant Container Information Adding Station, Such As, a Labeling Station Having a Sleeve Label Cutting Arrangement, Configured to Add Information to Containers, Such As, Bottles and Cans;" Ser. No. 10/801,924, filed on Mar. 16, 2004, having, entitled "Beverage Bottling Plant for Filling Bottles with a Liquid Beverage Filling Material, and a Cleaning Device for Cleaning Bottles in a Beverage Bottling Plant;" Ser. No. 10/813,651, filed on Mar. 30, 2004, having entitled "A Beverage Bottling Plant for Filling Bottles with a Liquid Beverage Filling Material, and an Easily Cleaned Lifting Device in a Beverage Bottling Plant;" Ser. No. 10/814,624, filed on Mar. 31, 2004, having entitled "A Beverage Bottling Plant for Filling Bottles with a Liquid Beverage Filling Material, and a Container Filling Plant Container Information Adding Station, Such As, a Labeling Station Having a Gripper Arrangement, Configured to Add Information to Containers, Such As, Bottles and Cans;" Ser. No. 10/816,787, filed on Apr. 2, 2004, having entitled "A Beverage Bottling Plant for Filling Bottles with a Liquid Beverage Filling Material, and Apparatus for Attaching Carrying Grips to Containers with Filled Bottles;" Ser. No. 10/865,240, filed on Jun. 10, 2004, having Entitled "A Beverage Bottling Plant for Filling Bottles with a Liquid Beverage Filling Material, a Beverage Container Filling Machine, and a Beverage Container Closing Machine;" Ser. No. 10/883,591, filed on Jul. 1, 2004, having entitled "A Beverage Bottling Plant for Filling Bottles with a Liquid Beverage Filling Material Having a Container Filling Plant Container Information Adding Station, Such As, a Labeling Station, Configured to Add Information to Containers, Such As, Bottles and Cans, and Modules for Labeling Stations and a Bottling Plant Having a Mobile Module Carrier;" Ser. No. 10/930,678, filed on Aug. 31, 2004, having, entitled "A Beverage Bottling Plant for Filling Bottles with a Liquid Beverage Filling Material, a Container Filling Plant Container Filling Machine, and a Filter Apparatus for Filtering a Liquid Beverage;" Ser. No. 10/931,817, filed on Sep. 1, 2004, having, entitled "A Beverage Bottling Plant for Filling Bottles with a Liquid Beverage Filling Material, Having an Apparatus for Exchanging Operating Units Disposed at Rotating Container Handling Machines;" Ser. No. 10/939,170, filed on Sep. 10, 2004, having; Ser. No. 10/954,012, filed on Sep. 29, 2004, having; Ser. No. 10/952,706, having; Ser. No. 10/962,183, filed on Oct. 8, 2004, having; Ser. No. 10/967,016, filed on Oct. 15, 2004, having Ser. No. 10/982,706, filed on Nov. 5, 2004, having Ser. No. 10/982,694, having Ser. No. 10/982,710, having Ser. No. 10/984,677, filed on Nov. 9, 2004, having Ser. No. 10/985,640, filed on Nov. 10, 2004, having Ser. No. 11/004,663, filed on Dec. 3, 2004, having Ser. No. 11/009,551, filed on Dec. 10, 2004, having Ser. No. 11/012,859, filed on Dec. 15, 2004, having Ser. No. 11/014,673, filed on Dec. 16, 2004, having Ser. No. 11/016,364, filed on Dec. 17, 2004, having; and Ser. No. 11/016,363, having.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

Some examples of computer systems that may possibly be utilized or possibly adapted for use in at least one possible embodiment of the present application may possibly be found in the following U.S. Pat. No. 5,416,480 issued to Roach et al. on May 16, 1995; U.S. Pat. No. 5,479,355 issued to Hyduke on Dec. 26, 1995; U.S. Pat. No. 5,481,730 issued to Brown et al. on Jan. 2, 1996; U.S. Pat. No. 5,805,094 issued to Roach et al. on Sep. 8, 1998; U.S. Pat. No. 5,881,227 issued to Atkinson et al. on Mar. 9, 1999; and U.S. Pat. No. 6,072,462 issued to Moshovich on Jun. 6, 2000.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

Some examples of cameras or the like optical monitoring apparatus that may possibly be utilized or possibly adapted for use in at least one possible embodiment of the present application may possibly be found in the following U.S. Pat. No. 5,233,186 issued to Ringlien on Aug. 3, 1993; U.S. Pat. No. 5,243,400 issued to Ringlien on Sep. 7, 1993; U.S. Pat. No. 5,369,713 issued to Schwartz et al. on Nov. 29, 1994; U.S. Pat. No. 5,442,446 issued to Gerber et al. on Aug. 15, 1995; U.S. Pat. No. 5,661,295 issued to Buchmann et al. on Aug. 26, 1997; and U.S. Pat. No. 5,898,169 issued to Nodbryhn on Apr. 27, 1999.

The corresponding foreign and international patent publication applications, namely, Federal Republic of Germany Patent Application No. 10 2004 005 994.2, filed on Feb. 6, 2004, having inventor Klaus Thatenhorst, and DE-OS 10 2004 005 994.2 and DE-PS 10 2004 005 994.2, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

Some examples of rotation sensors that may possibly be utilized or possibly adapted for use in at least one possible embodiment of the present application may possibly be found in the following U.S. Pat. No. 6,246,232 issued to Okamura on Jun. 12, 2001; U.S. Pat. No. 6,448,761 issued to Stumpe on Sep. 10, 2002; U.S. Pat. No. 6,474,162 to Voss et al. on Nov. 5, 2002; U.S. Pat. No. 6,498,481 issued to Apel on Dec. 24, 2002; U.S. Pat. No. 6,532,831 issued to Jin et al. on Mar. 18, 2003; and U.S. Pat. No. 6,672,175 issued to Jin et al. on Jan. 6, 2004.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

Some examples of adhesive applicators that may possibly be utilized or possibly adapted for use in at least one possible embodiment of the present application may possibly be found in the following U.S. Pat. No. 5,700,322 issued to Fort on Dec. 23, 1997 U.S. Pat. No. 5,862,986 issued to Bolyard, Jr. et al. on Jan. 26, 1999; U.S. Pat. No. 6,076,711 issued to McGuffey on Jun. 20, 2000; U.S. Pat. No. 6,168,049 issued to Bollard, Jr. on Jan. 2, 2001; U.S. Pat. No. 6,499,631 issued to Zook on Dec. 31, 2002; and U.S. Pat. No. 6,592,281 issued to Clark et al. on Jul. 15, 2003.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

Some examples of centering devices for bottle handling devices which may possibly be utilized or adapted for use in at least one possible embodiment may possibly be found in Federal Republic of Germany Application No. DE P 103 14 634, entitled "Spülbares Huborgan" having inventor Herbert Bernhard, and its U.S. equivalent, having Ser. No. 10/813, 657, entitled "A beverage bottling plant for filling bottles with a liquid beverage filling material, and an easily cleaned lifting device in a beverage bottling plant" and filed on Mar. 30, 2004; Federal Republic of Germany Application No. DE P 103 08 156, entitled "Huborgan zum Anpressen von Gefässen an Gefässfüllmaschinen" having inventor Herbert Bernhard, and its U.S. equivalent, Ser. No. 10/786,256, entitled "A beverage bottling plant for filling bottles with a liquid beverage filling material, and a container filling lifting device for pressing containers to container filling machines", filed on Feb. 25, 2004; and Federal Republic of Germany Application No. P 103 26 618.6, filed on Jun. 13, 2003, having inventor Volker TILL, and its U.S. equivalent, Ser. No. 10/865,240, filed on Jun. 10, 2004 and having. The above applications are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

Some examples of labeling machines which may possibly be utilized in at least one possible embodiment may possibly be found in the following U.S. Pat. No. 6,634,400, entitled "Labeling machine;" U.S. Pat. No. 6,561,246, entitled "Labeling machine capable of precise attachment of a label to different sizes of containers;" U.S. Pat. No. 6,550,512, entitled "Labeling machine capable of preventing erroneous attachment of labels on containers;" U.S. Pat. No. 6,543,514, entitled "In-line continuous feed sleeve labeling machine and method;" U.S. Pat. No. 6,378,587, entitled "Cylindrical container labeling machine;" U.S. Pat. No. 6,328,086, entitled "Labeling machine;" U.S. Pat. No. 6,315,021, entitled "Labeling machine;" U.S. Pat. No. 6,263,940, entitled "In-line continuous feed sleeve labeling machine and method;" U.S. Pat. No. 6,199,614, entitled "High speed labeling machine having a constant tension driving system;" U.S. Pat. No. 6,167,935, entitled "Labeling machine; U.S. Pat. No. 6,066,223, entitled "Labeling machine and method; U.S. Pat. No. 6,050,319, entitled "Non-round container labeling machine and method;" and U.S. Pat. No. 6,045,616, entitled "Adhesive station and labeling machine."

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

Some examples of starwheels which may possibly be utilized or adapted for use in at least one possible embodiment may possibly be found in the following U.S. Pat. No. 5,613,593, entitled "Container handling starwheel;" U.S. Pat. No. 5,029,695, entitled "Improved starwheel;" U.S. Pat. No. 4,124,112, entitled "Odd-shaped container indexing starwheel;" and U.S. Pat. No. 4,084,686, entitled "Starwheel control in a system for conveying containers."

The abstract of the disclosure is submitted herewith as required by 37 C.F.R. §1.72(b). As stated in 37 C.F.R. §1.72 (b):

A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

Some examples of position sensors or position sensor systems that may be used or adapted for use in at least one possible embodiment of the present invention may be found in the following U.S. Pat. No. 5,794,355, issued to inventor Nickum on Aug. 18, 1998; U.S. Pat. No. 5,520,290, issued to inventors Kumar et al. on May 28, 1996; U.S. Pat. No. 5,074,053, issued to inventor West on Dec. 24, 1991; and U.S. Pat. No. 4,087,012, issued to inventor Fogg on May 2, 1978.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

What is claimed is:

1. A beverage bottling plant for filling beverage bottles with liquid beverage material, said beverage bottling plant comprising:

a beverage bottle cleaning machine being configured and disposed to clean beverage bottles;

a feed arrangement to supply beverage bottles to said beverage bottle cleaning machine;

a beverage filling machine being configured and disposed to fill beverage bottles with liquid beverage material;

said beverage filling machine comprising a plurality of beverage filling devices for filling beverage bottles with liquid beverage material;

at least one storage unit being configured and disposed to store a supply of liquid beverage material;

at least one supply line being configured and disposed to connect said at least one storage unit to said beverage filling machine to supply liquid beverage material to said beverage filling machine;

a first conveyer arrangement being configured and disposed to move beverage bottles from said beverage bottle cleaning machine into said beverage filling machine;

a beverage bottle closing machine being configured and disposed to close filled beverage bottles;

a second conveyer arrangement being configured and disposed to move filled beverage bottles from said beverage filling machine into said beverage bottle closing machine;

a beverage bottle labeling station being configured and disposed to label filled, closed beverage bottles;

a third conveyor arrangement being configured and disposed to move filled, closed beverage bottles from said beverage bottle closing machine into said beverage bottle labeling station;

a beverage bottle packing station being configured and disposed to package labeled, filled, closed beverage bottles;

a fourth conveyor arrangement being configured and disposed to move labeled, filled, closed beverage bottles from said beverage bottle labeling station to said beverage bottle packing station;

a computer control system being configured and disposed to monitor and control operation of said beverage bottling plant;

said beverage bottle labeling station comprising:

a rotary bottle carrier being configured and disposed to rotate in a horizontal plane;

said rotary bottle carrier comprising individual bottle supports disposed about the periphery of said rotary bottle carrier;

said bottle supports being configured and disposed to support and hold bottles in a vertical position with the filling openings of the bottles in an uppermost position;

at least one beverage bottle labeling machine;

said at least one beverage bottle labeling machine being disposed adjacent said rotary bottle carrier and being configured and disposed to attach labels to bottles on said individual bottle supports;

a label position control device being disposed adjacent said rotary bottle carrier, and being configured to inspect labeled bottles to monitor the smoothness and the position of labels on bottles and transmit inspection data to said computer control system; and said at least one beverage bottle labeling machine comprising:

a label supply container being configured and disposed to contain a supply of labels;

a rotary label carrier being configured and disposed to remove labels from said label supply container;

said rotary label carrier comprising a plurality of pie-piece-shaped elements disposed about the periphery of said rotary label carrier;

each of said pie-piece-shaped elements being configured and disposed to pick up an individual label from said supply of labels as said rotary label carrier rotates about a central axis;

an adhesive roller being configured and disposed to apply adhesive to labels being held on said pie-piece-elements as said pie-piece-elements are rotated on said rotary label carrier and past said adhesive roller;

a rotary gripper cylinder being configured and disposed to receive labels from said rotary label carrier and to attach labels to bottles;

said rotary gripper cylinder comprising a plurality of gripper surfaces disposed about the periphery of said rotary gripper cylinder;

each of said gripper surfaces being configured and disposed to receive an individual label from a pie-piece-shaped element as said pie-piece-shaped elements and said gripper surfaces are rotated past one another respectively on said rotary label carrier and said rotary gripper cylinder;

a support table structure;

said label supply container, said rotary label carrier, said adhesive roller, and said gripper cylinder each being affixed to and mounted on said support table structure; and a hexapod transmission arrangement comprising six motor-driven, variable-length adjustment arms being connected to said support table structure to move said support table structure, and said label supply container, said rotary label carrier, said adhesive roller, and said gripper cylinder mounted thereon, in all of (A), (B), (C), (D), (E), (F), and (G):

(A) up and down movements along a vertical axis;

(B) forward and backward movements along a horizontal axis towards and away from said rotary bottle carrier;

(C) sideways movements along an axis being substantially parallel to a tangent of the outer periphery of said rotary bottle carrier;

(D) rotational movement about a vertical rotational axis;

(E) rotational movement about a horizontal rotational axis;

(F) rotational movement about a rotational axis being substantially parallel to a tangent of the outer periphery of said rotary bottle carrier; and (G) combinations of at least two of the movements (A), (B), (C), (D), (E), and (F);

said hexapod transmission arrangement comprising a base structure being disposed opposite to and facing said support table structure;

said six adjustment arms comprising a first adjustment arm, a second adjustment arm, a third, adjustment arm, a fourth adjustment arm, a fifth adjustment arm, and a sixth adjustment arm;

each of said adjustment arms being disposed in sequence one after another, where said first adjustment arm is first in sequence and said sixth adjustment arm is last in sequence, and clockwise about said support table structure as seen from said base structure, wherein:

said first adjustment arm is disposed between said sixth adjustment arm and said second adjustment arm, said second adjustment arm is disposed between said first adjustment arm and said third adjustment arm, said third adjustment arm is disposed between said second adjustment arm and said fourth adjustment arm, said fourth adjustment arm is disposed between said third adjustment arm and said fifth adjustment arm, said fifth adjustment arm is disposed between said fourth adjustment arm and said sixth adjustment arm, and said sixth adjustment arm is disposed between said fifth adjustment arm and said first adjustment arm;

each of said adjustment arms having a first end and a second end opposite said first end;

said first end of each of said adjustment arms all being connected to one of: said table support structure and said base structure;

said second end of each of said adjustment arms all being connected to the other one of: said support table structure and said base structure not connected to said first end of each of said adjustment arms;

said second ends of said first and second adjustment arms being disposed closer to one another than said first ends of said first and second adjustment arms;

said second ends of said third and fourth adjustment arms being disposed closer to one another than said first ends of said third and fourth adjustment arms; and said second ends of said fifth and sixth adjustment arms being disposed closer to one another than said first ends of said fifth and sixth adjustment arms;

said computer control system being operatively connected to said transmission arrangement to control the operation of said transmission arrangement in the movements of (A), (B), (C), (D), (E), and (F), and combinations thereof, and thus to control the movement of said support table to thus orient said gripper cylinder with respect to bottles in said rotary bottle carrier to permit smooth attachment of labels in a desired position on the bottles; and said computer control system being configured and operatively connected to send signals to actuate said transmission arrangement to adjust the position of said support table, and thus said gripper cylinder, upon receipt of inspection data from said label position control device indicating an error in the attachment of labels, or upon receipt of data indicating a change in the type of labels being used or the type of bottles being labeled, to thus orient said gripper cylinder with respect to bottles in said rotary bottle carrier to permit smooth attachment of labels in a desired position on the bottles.

2. The bottling plant according to claim 1, wherein:

said at least one labeling machine comprises a cross-slide arrangement connected to and disposed above or below said transmission arrangement to permit further translational movement of said support table structure; and for the determination of the respective three-dimensional position of said labeling machine with respect to the label transfer position or its starting and ending position, said labeling machine comprises position transducers that relate to at least one of space and distance.

3. The bottling plant according to claim 2, wherein:

said at least one labeling machine comprises a load sensor;

said load sensor is operatively connected to said gripper cylinder to control the label transfer position and the label application pressure;

said labeling station comprises a peripheral support structure disposed about the periphery of said rotary label carrier;

said transmission arrangement comprises a connecting structure configured to connect said transmission arrangement to said peripheral support structure to one of:

fixedly attach said transmission arrangement to said peripheral support structure; and removably attach said transmission arrangement to said peripheral support structure.

4. The bottling plant according to claim 3, wherein:

said at least one labeling machine is an integral unit configured to be connected to said peripheral support structure at a desired position on said peripheral support structure to perform a desired labeling process;

said transmission arrangement comprises a quick-release connecting structure to permit attachment and detachment of said at least one labeling machine to said peripheral support structure;

said transmission arrangement comprises a six-axis adjustment device;

movement commands for said transmission arrangement are entered in the form of object coordinates that are referenced to the bottles or in movement commands that are referenced to the axes of movement of said labeling machine in three-dimensional space; and at least one of the object coordinates and movement commands referenced to the axes in three-dimensional space can be converted into corresponding movement commands for the axis coordinates by a real-time transformation.

5. The bottling plant according to claim 3, wherein:

said support table structure, said label supply container, said rotary label carrier, said adhesive roller, and said gripper cylinder of said at least one labeling machine together form an integral unit separate from and configured to be removably connected to a corresponding transmission arrangement to form a labeling machine;

said peripheral support structure has at least one transmission arrangement fixedly attached thereto to permit removable connection of said support table structure of said at least one labeling machine;

said transmission arrangement comprises a six-axis adjustment device;

movement commands for said transmission arrangement are entered in the form of object coordinates that are referenced to the bottles or in movement commands that are referenced to the axes of movement of said labeling machine in three-dimensional space; and at least one of the object coordinates and movement commands referenced to the axes in three-dimensional space can be converted into corresponding movement commands for the axis coordinates by a real-time transformation.

6. The bottling plant according to claim 3, wherein:

said support table structure, said label supply container, said rotary label carrier, said adhesive roller, and said gripper cylinder of said at least one labeling machine together form an integral unit separate from and configured to be removably connected to a corresponding transmission arrangement to form a labeling machine;

said peripheral support structure has at least one transmission arrangement attached thereto to permit removable connection of said support table structure of said at least one labeling machine;

said at least one transmission arrangement on said peripheral support structure is configured to be detached from one position on said peripheral support structure and reattached at another position on said peripheral support structure to permit different desired labeling processing;

said transmission arrangement comprises a six-axis adjustment device;

movement commands for said transmission arrangement are entered in the form of object coordinates that are referenced to the bottles or in movement commands that are referenced to the axes of movement of said labeling machine in three-dimensional space; and at least one of the object coordinates and movement command referenced to the axes in three-dimensional space can be converted into corresponding movement command for the axis coordinates by a real-time transformation.

7. A beverage bottling plant for filling beverage bottles with liquid beverage material, said beverage bottling plant comprising:

a beverage bottle cleaning machine being configured and disposed to clean beverage bottles;

a feed arrangement to supply beverage bottles to said beverage bottle cleaning machine;

a beverage filling machine being configured and disposed to fill beverage bottles with liquid beverage material;

said beverage filling machine comprising a plurality of beverage filling devices for filling beverage bottles with liquid beverage material;

at least one storage unit being configured and disposed to store a supply of liquid beverage material;

at least one supply line being configured and disposed to connect said at least one storage unit to said beverage filling machine to supply liquid beverage material to said beverage filling machine;

a first conveyer arrangement being configured and disposed to move beverage bottles from said beverage bottle cleaning machine into said beverage filling machine;

a beverage bottle closing machine being configured and disposed to close filled beverage bottles;

a second conveyer arrangement being configured and disposed to move filled beverage bottles from said beverage filling machine into said beverage bottle closing machine;

a beverage bottle labeling station being configured and disposed to label filled, closed beverage bottles;

a third conveyor arrangement being configured and disposed to move filled, closed beverage bottles from said beverage bottle closing machine into said beverage bottle labeling station;

a beverage bottle packing station being configured and disposed to package labeled, filled, closed beverage bottles;

a fourth conveyor arrangement being configured and disposed to move labeled, filled, closed beverage bottles from said beverage bottle labeling station to said beverage bottle packing station;

a computer control system being configured and disposed to monitor and control operation of said beverage bottling plant;

said beverage bottle labeling station comprising;

a rotary bottle carrier being configured and disposed to rotate in a horizontal plane;

said rotary bottle carrier comprising individual bottle supports disposed about the periphery of said rotary bottle carrier;

said bottle supports being configured and disposed to support and hold bottles in a vertical position with the filling openings of the bottles in an uppermost position;

at least one beverage bottle labeling machine;

said at least one beverage bottle labeling machine being disposed adjacent said rotary bottle carrier and being configured and disposed to attach labels to bottles on said individual bottle supports;

a label position control device being disposed adjacent said rotary bottle carrier, and being configured to inspect labeled bottles to monitor the position of labels on bottles and transmit inspection data to said computer control system; and said at least one beverage bottle labeling machine comprising:

a label supply container being configured and disposed to contain a supply of labels;

a rotary label carrier being configured and disposed to remove labels from said label supply container;

said rotary label carrier comprising a plurality of pie-piece-shaped elements disposed about the periphery of said rotary label carrier;

each of said pie-piece-shaped elements being configured and disposed to pick up an individual label from said supply of labels as said rotary label carrier rotates about a central axis;

an adhesive roller being configured and disposed to apply adhesive to labels being held on said pie-piece-elements as said pie-piece-elements are rotated on said rotary label carrier and past said adhesive roller;

a rotary gripper cylinder being configured and disposed to receive labels from said rotary label carrier and to attach labels to bottles;

said rotary gripper cylinder comprising a plurality of gripper surfaces disposed about the periphery of said rotary gripper cylinder;

each of said gripper surfaces being configured and disposed to receive an individual label from a pie-piece-shaped element as said pie-piece-shaped elements and said gripper surfaces are rotated past one another respectively on said rotary label carrier and said rotary gripper cylinder;

a support table structure;

said label supply container, said rotary label carrier, said adhesive roller, and said gripper cylinder each being affixed to and mounted on said support table structure; and a transmission arrangement comprising a plurality of motor-driven, variable-length adjustment arms being connected to said support table structure to move said support table structure, and said label supply container, said rotary label carrier, said adhesive roller, and said gripper cylinder mounted thereon, in all of (A), (B), and (C), at least one of (D), (E), and (F), and (G):

(A) up and down movements along a vertical axis;

(B) forward and backward movements along a horizontal axis towards and away from said rotary bottle carrier;

(C) sideways movements along an axis being substantially parallel to a tangent of the outer periphery of said rotary bottle carrier;

(D) rotational movement about a vertical rotational axis;

(E) rotational movement about a horizontal rotational axis; and (F) rotational movement about a rotational axis being substantially parallel to a tangent of the outer periphery of said rotary bottle carrier;

(G) combinations of at least two of the movements (A), (B), and (C), or at least one of the movements (A), (B), and (C) and at least one of the movements (D), (E), and (F);

said computer control system being operatively connected to said transmission arrangement to control the operation of said transmission arrangement in the movements of all of (A), (B), and (C), at least one of (D), (E), and (F), and (G), and thus to control the movement of said support table to thus orient said gripper cylinder with respect to bottles in said rotary bottle carrier to permit attachment of labels in a desired position on the bottles; and said computer control system being configured and operatively connected to send signals to actuate said transmission arrangement to adjust the position of said support table, and thus said gripper cylinder, upon receipt of inspection data from said label position control device indicating an error in the attachment of labels, or upon receipt of data indicating a change in the type of labels being used or the type of bottles being labeled, to thus orient said gripper cylinder with respect to bottles in said rotary bottle carrier to permit attachment of labels in a desired position on the bottles;

said transmission arrangement comprises a hexapod transmission arrangement;

said hexapod transmission arrangement comprises a base structure being disposed opposite to and facing said support table structure;

said plurality of adjustment arms comprises a first adjustment arm, a second adjustment arm, a third, adjustment arm, a fourth adjustment arm, a fifth adjustment arm, and a sixth adjustment arm;

each of said adjustment arms is disposed in sequence one after another, where said first adjustment arm is first in sequence and said sixth adjustment arm is last in sequence, and clockwise about said support table structure as seen from said base structure, wherein:

said first adjustment arm is disposed between said sixth adjustment arm and said second adjustment arm, said second adjustment arm is disposed between said first adjustment arm and said third adjustment arm, said third adjustment arm is disposed between said second adjustment arm and said fourth adjustment arm, said fourth adjustment arm is disposed between said third adjustment arm and said fifth adjustment arm, said fifth adjustment arm is disposed between said fourth adjustment arm and said sixth adjustment arm, and said sixth adjustment arm is disposed between said fifth adjustment arm and said first adjustment arm;

each of said adjustment arms has a first end and a second end opposite said first end;

said first end of each of said adjustment arms all are connected to one of: said table support structure and said base structure;

said second end of each of said adjustment arms all are connected to the other one of: said support table structure and said base structure not connected to said first end of each of said adjustment arms;

said second ends of said first and second adjustment arms are disposed closer to one another than said first ends of said first and second adjustment arms;

said second ends of said third and fourth adjustment arms are disposed closer to one another than said first ends of said third and fourth adjustment arms; and said second ends of said fifth and sixth adjustment arms are disposed closer to one another than said first ends of said fifth and sixth adjustment arms.

8. The bottling plant according to claim 7, wherein said at least one labeling machine comprises a cross-slide arrangement connected to and disposed above or below said transmission arrangement to permit further translational movement of said support table structure.

9. The bottling plant according to claim 8, wherein for the determination of the respective three-dimensional position of said labeling machine with respect to the label transfer position or its starting and ending position, said labeling machine comprises position transducers that relate to at least one of space and distance.

10. The bottling plant according to claim 9, wherein:

said at least one labeling machine comprises a load sensor; and said load sensor is operatively connected to said gripper cylinder to control the label transfer position and the label application pressure.

11. The bottling plant according to claim 10, wherein:

said labeling station comprises a peripheral support structure disposed about the periphery of said rotary label carrier;

said transmission arrangement comprises a connecting structure configured to connect said transmission arrangement to said peripheral support structure to one of:

fixedly attach said transmission arrangement to said peripheral support structure; and removably attach said transmission arrangement to said peripheral support structure.

12. The bottling plant according to claim 11, wherein:

said transmission arrangement comprises a six-axis adjustment device;

movement commands for said transmission arrangement are entered in the form of object coordinates that are referenced to the bottles or in movement commands that are referenced to the axes of movement of said labeling machine in three-dimensional space; and at least one of the object coordinates and movement commands referenced to the axes in three-dimensional space can be converted into corresponding movement commands for the axis coordinates by a real-time transformation.

13. The bottling plant according to claim 12, wherein:

said at least one labeling machine is an integral unit configured to be connected to said peripheral support structure at a desired position on said peripheral support structure to perform a desired labeling process; and said transmission arrangement comprises a quick-release connecting structure to permit attachment and detachment of said at least one labeling machine to said peripheral support structure.

14. The bottling plant according to claim 12, wherein:

said support table structure, said label supply container, said rotary label carrier, said adhesive roller, and said gripper cylinder of said at least one labeling machine together form an integral unit separate from and configured to be removably connected to a corresponding transmission arrangement to form a labeling machine; and said peripheral support structure has at least one transmission arrangement fixedly attached thereto to permit removable connection of said support table structure of said at least one labeling machine.

15. The bottling plant according to claim 12, wherein:

said support table structure, said label supply container, said rotary label carrier, said adhesive roller, and said gripper cylinder of said at least one labeling machine together form an integral unit separate from and configured to be removably connected to a corresponding transmission arrangement to form a labeling machine;

said peripheral support structure has at least one transmission arrangement attached thereto to permit removable connection of said support table structure of said at least one labeling machine; and said at least one transmission arrangement on said peripheral support structure is configured to be detached from one position on said peripheral support structure and reattached at another position on said peripheral support structure to permit different desired labeling processes.

16. A beverage bottling plant for filling beverage bottles with liquid beverage material, said beverage bottling plant comprising:

a beverage bottle cleaning machine being configured and disposed to clean beverage bottles;

a feed arrangement to supply beverage bottles to said beverage bottle cleaning machine;

a beverage filling machine being configured and disposed to fill beverage bottles with liquid beverage material;

said beverage filling machine comprising a plurality of beverage filling devices for filling beverage bottles with liquid beverage material;

at least one storage unit being configured and disposed to store a supply of liquid beverage material;

at least one supply line being configured and disposed to connect said at least one storage unit to said beverage filling machine to supply liquid beverage material to said beverage filling machine;

a first conveyer arrangement being configured and disposed to move beverage bottles from said beverage bottle cleaning machine into said beverage filling machine;

a beverage bottle closing machine being configured and disposed to close filled beverage bottles;

a second conveyer arrangement being configured and disposed to move filled beverage bottles from said beverage filling machine into said beverage bottle closing machine;

a beverage bottle labeling station being configured and disposed to label filled, closed beverage bottles;

a third conveyor arrangement being configured and disposed to move filled, closed beverage bottles from said beverage bottle closing machine into said beverage bottle labeling station;

a beverage bottle packing station being configured and disposed to package labeled, filled, closed beverage bottles;

a fourth conveyor arrangement being configured and disposed to move labeled, filled, closed beverage bottles from said beverage bottle labeling station to said beverage bottle packing station;

a computer control system being configured and disposed to monitor and control operation of said beverage bottling plant;

said beverage bottle labeling station comprising:

a rotary bottle carrier being configured and disposed to rotate in a horizontal plane;

said rotary bottle carrier comprising individual bottle supports disposed about the periphery of said rotary bottle carrier;

said bottle supports being configured and disposed to support and hold bottles in a vertical position with the filling openings of the bottles in an uppermost position;

at least one beverage bottle labeling machine;

said at least one beverage bottle labeling machine being disposed adjacent said rotary bottle carrier and being configured and disposed to attach labels to bottles on said individual bottle supports;

a label position control device being disposed adjacent said rotary bottle carrier, and being configured to inspect labeled bottles to monitor the position of labels on bottles and transmit inspection data to said computer control system; and said at least one beverage bottle labeling machine comprising:

a label supply container being configured and disposed to contain a supply of labels;

a rotary label carrier being configured and disposed to remove labels from said label supply container;

said rotary label carrier comprising a plurality of pie-piece-shaped elements disposed about the periphery of said rotary label carrier;

each of said pie-piece-shaped elements being configured and disposed to pick up an individual label from said supply of labels as said rotary label carrier rotates about a central axis;

an adhesive roller being configured and disposed to apply adhesive to labels being held on said pie-piece- elements as said pie-piece-elements are rotated on said rotary label carrier and past said adhesive roller;

a rotary gripper cylinder being configured and disposed to receive labels from said rotary label carrier and to attach labels to bottles;

said rotary gripper cylinder comprising a plurality of gripper surfaces disposed about the periphery of said rotary gripper cylinder;

each of said gripper surfaces being configured and disposed to receive an individual label from a pie-piece- shaped element as said pie-piece-shaped elements and said gripper surfaces are rotated past one another respectively on said rotary label carrier and said rotary gripper cylinder;

a support table structure;

said label supply container, said rotary label carrier, said adhesive roller, and said gripper cylinder each being affixed to and mounted on said support table structure; and a transmission arrangement comprising a plurality of motor-driven, variable-length adjustment arms being connected to said support table structure to move said support table structure, and said label supply container, said rotary label carrier, said adhesive roller, and said gripper cylinder mounted thereon, in at least two of (A), (B), (C), (D), (E), and (F):

(A) up and down movements along a vertical axis;

(B) forward and backward movements along a horizontal axis towards and away from said rotary bottle carrier;

(C) sideways movements along an axis being substantially parallel to a tangent of the outer periphery of said rotary bottle carrier;

(D) rotational movement about a vertical rotational axis;

(E) rotational movement about a horizontal rotational axis; and (F) rotational movement about a rotational axis being substantially parallel to a tangent of the outer periphery of said rotary bottle carrier;

said computer control system being operatively connected to said transmission arrangement to control the operation of said transmission arrangement in the movements of at least two of (A), (B), (C), (D), (E), and (F), and thus to control the movement of said support table to thus orient said gripper cylinder with respect to bottles in said rotary bottle carrier to permit attachment of labels in a desired position on the bottles;

said computer control system being configured and operatively connected to send signals to actuate said transmission arrangement to adjust the position of said support table, and thus said gripper cylinder, upon receipt of inspection data from said label position control device indicating an error in the attachment of labels, or upon receipt of data indicating a change in the type of labels being used or the type of bottles being labeled, to thus orient said gripper cylinder with respect to bottles in said rotary bottle carrier to permit attachment of labels in a desired position on the bottles;

said transmission arrangement comprises a hexapod transmission arrangement;

said hexapod transmission arrangement comprises a base structure being disposed opposite to and facing said support table structure;

said plurality of adjustment arms comprises a first adjustment arm, a second adjustment arm, a third, adjustment arm, a fourth adjustment arm, a fifth adjustment arm, and a sixth adjustment arm;

each of said adjustment arms is disposed in sequence one after another, where said first adjustment arm is first in sequence and said sixth adjustment arm is last in sequence, and clockwise about said support table structure as seen from said base structure, wherein;

said first adjustment arm is disposed between said sixth adjustment arm and said second adjustment arm, said second adjustment arm is disposed between said first adjustment arm and said third adjustment arm, said third adjustment arm is disposed between said second adjustment arm and said fourth adjustment arm, said fourth adjustment arm is disposed between said third adjustment arm and said fifth adjustment arm, said fifth adjustment arm is disposed between said fourth adjustment arm and said sixth adjustment arm, and said sixth adjustment arm is disposed between said fifth adjustment arm and said first adjustment arm;

each of said adjustment arms has a first end and a second end opposite said first end;

said first end of each of said adjustment arms all are connected to one of: said table support structure and said base structure;

said second end of each of said adjustment arms all are connected to the other one of: said support table structure and said base structure not connected to said first end of each of said adjustment arms;

said second ends of said first and second adjustment arms are disposed closer to one another than said first ends of said first and second adjustment arms;

said second ends of said third and fourth adjustment arms are disposed closer to one another than said first ends of said third and fourth adjustment arms; and said second ends of said fifth and sixth adjustment arms are disposed closer to one another than said first ends of said fifth and sixth adjustment arms.

17. The bottling plant according to claim 16, wherein said transmission arrangement is connected to said support table structure to move said support table structure, and said label supply container, said rotary label carrier, said adhesive roller, and said gripper cylinder mounted thereon, in at least three of the movements (A), (B), (C), (D), (E), and (F).

18. The bottling plant according to claim 17, wherein said transmission arrangement is connected to said support table structure to move said support table structure, and said label supply container, said rotary label carrier, said adhesive roller, and said gripper cylinder mounted thereon, in all of the movements (A), (B), and (C).

19. The bottling plant according to claim 18, wherein:

said transmission arrangement is connected to said support table structure to move said support table structure, and said label supply container, said rotary label carrier, said adhesive roller, and said gripper cylinder mounted thereon, in all of the movements (D), (E), and (F);

said at least one labeling machine comprises a cross-slide arrangement connected to and disposed above or below said transmission arrangement to permit further translational movement of said support table structure;

for the determination of the respective three-dimensional position of said labeling machine with respect to the label transfer position or its starting and ending position, said labeling machine comprises position transducers that relate to at least one of space and distance;

said at least one labeling machine comprises a load sensor;

said load sensor is operatively connected to said gripper cylinder to control the label transfer position and the label application pressure;

said labeling station comprises a peripheral support structure disposed about the periphery of said rotary label carrier;

said transmission arrangement comprises a connecting structure configured to connect said transmission arrangement to said peripheral support structure to one of:

fixedly attach said transmission arrangement to said peripheral support structure; and removably attach said transmission arrangement to said peripheral support structure;

said transmission arrangement comprises a six-axis adjustment device;

movement commands for said transmission arrangement are entered in the form of object coordinates that are referenced to the bottles or in movement commands that are referenced to the axes of movement of said labeling machine in three-dimensional space;

at least one of the object coordinates and movement commands referenced to the axes in three-dimensional space can be converted into corresponding movement commands for the axis coordinates by a real-time transformation; and one of (G), (H), and (I):

(G) said at least one labeling machine is an integral unit configured to be connected to said peripheral support structure at a desired position on said peripheral support structure to perform a desired labeling process; and said transmission arrangement comprises a quick-release connecting structure to permit attachment and detachment of said at least one labeling machine to said peripheral support structure;

(H) said support table structure, said label supply container, said rotary label carrier, said adhesive roller, and said gripper cylinder of said at least one labeling machine together form an integral unit separate from and configured to be removably connected to a corresponding transmission arrangement to form a labeling machine; and said peripheral support structure has at least one transmission arrangement fixedly attached thereto to permit removable connection of said support table structure of said at least one labeling machine; and (I) said support table structure, said label supply container, said rotary label carrier, said adhesive roller, and said gripper cylinder of said at least one labeling machine together form an integral unit separate from and configured to be removably connected to a corresponding transmission arrangement to form a labeling machine;

said peripheral support structure has at least one transmission arrangement attached thereto to permit removable connection of said support table structure of said at least one labeling machine; and said at least one transmission arrangement on said peripheral support structure is configured to be detached from one position on said peripheral support structure and reattached at another position on said peripheral support structure to permit different desired labeling processes.

* * * * *